US005380177A

United States Patent [19]

Leroy et al.

[11] Patent Number: 5,380,177

[45] Date of Patent: Jan. 10, 1995

[54] POSITIVE DISPLACEMENT MACHINE WITH PLANETARY MOTION AND HYPERTROCHOIDAL GEOMETRY

[76] Inventors: Andre Leroy, 64 Chaussee de Binche, B 7030 Mons, Belgium; Flamme, Jean Marie, 23 Boulevard Richard Lenoir, F 75011 Paris, France

[21] Appl. No.: 965,923

[22] Filed: Oct. 23, 1992

[30] Foreign Application Priority Data

Oct. 23, 1991 [FR] France ..... 91 13531

[51] Int. Cl.[6] ..... F01C 1/10; F01C 1/22; F01C 21/08; F01C 21/10

[52] U.S. Cl. ..... 418/61.2; 418/61.3; 418/150; 418/164; 418/166

[58] Field of Search ..... 418/54, 61.2, 61.3, 418/150, 164, 166

[56] References Cited

U.S. PATENT DOCUMENTS

| | | | |
|---|---|---|---|
| 2,988,008 | 6/1961 | Wankel | 418/61.2 |
| 2,994,277 | 8/1961 | Merritt | 418/150 |
| 3,955,903 | 5/1976 | de Dobo | 418/61.3 |
| 3,975,120 | 8/1976 | Tschirky | 418/48 |
| 3,975,121 | 8/1976 | Tschirky | 418/48 |
| 3,982,858 | 9/1976 | Tschirky | 418/48 |
| 3,999,901 | 12/1976 | Tschirky | 418/48 |
| 4,462,774 | 7/1984 | Hotine et al. | 418/61.3 |

FOREIGN PATENT DOCUMENTS

| | | | |
|---|---|---|---|
| 416850 | 7/1925 | | 418/61.3 |
| 1252836 | 12/1960 | France | 418/166 |
| 299642 | 8/1965 | Netherlands | 418/61.3 |
| 176112 | 2/1922 | United Kingdom | 418/61.3 |
| 583035 | 12/1946 | United Kingdom | 418/61.2 |
| 1038584 | 8/1983 | U.S.S.R. | 418/164 |

*Primary Examiner*—John L. Vrablik

*Attorney, Agent, or Firm*—Kerkam, Stowell, Kondracki & Clarke

[57] ABSTRACT

A positive displacement machine with planetary motion and hypertrochoidal geometry, including an enclosure arrangement essentially constituted by a cylindrical piston (11), and a cylindrical enclosure (10) and by a third device in rotoidal connection with this piston and this enclosure, characterized in that the directrix of the piston or of the enclosure is hypertrochoidal or uniformly distant from a hypertrochoid. The machine can carry any type of fluid and can convert mechanical energy into hydraulic energy or vice versa, depending on the nature of the distribution selected for assuring the admission and escape of the fluid. This admission may furthermore be adjustable, to assure a variation in the displacement. For well-chosen geometries, the direct contact between the enclosure and the piston may be used to create the relative motion between the piston and the enclosure and to make it unnecessary to use a separate transmission.

6 Claims, 5 Drawing Sheets

POSITIVE DISPLACEMENT MACHINE WITH PLANETARY MOTION AND HYPERTROCHOIDAL GEOMETRY

FIELD OF THE INVENTION

The invention relates to a positive displacement machine including a cylindrical machine essentially constituted by a cylindrical piston (male device), a cylindrical enclosure that surrounds it (female device), and a third device physically embodying two axes parallel to those of the cylindrical surfaces defining the shape of the piston and of the enclosure, this third device being connected in rotoidal fashion about its axes, with the piston and the enclosure, respectively. In these machines, the cylindrical surface defining the shape of the piston displays an order of symmetry with respect to its axis equal to $s_P$; that of the enclosure has an order of symmetry equal to $s_C$; $s_P$ and $s_C$ are selected such that these values differ from each other by one. Furthermore, the geometry of the piston and enclosure are selected so that there will be direct contact between these elements.

BACKGROUND OF THE INVENTION

Numerous positive displacement machines with planetary motion that match this description are known. Essentially, the machines that are described in the article entitled "Projektieren der Zykloidenverzahnungen hydraulischer Verdrängermaschinen" [Design of Cycloidal Gears in Hydraulic Machines], in Mechanism and Machine Theory, Vol. 25, No. 6, 1990, may be mentioned.

It will be observed that in these planetary-motion machines, in order to specify a value of $s_P$ differing from each other by one, the axis of the cylindrical surface defining the outer shape of the piston must be coincident with the axis of its rotoidal connection with the third device. Moreover, in the machines in which the value of $s_C$ differs from each other by one, the axis of the cylindrical surface defining the inside shape of the enclosure must be coincident with the axis of its rotoidal connection with the third device. When $s_P=1$, the axis of the cylindrical surface defining the outer shape of the piston may be selected arbitrarily, on the condition that it is parallel to the axes of the third device. When $s_C=1$, the axis of the cylindrical surface defining the inside shape of the enclosure may be selected arbitrarily, providing it is parallel to one of the axes of the third device.

Positive displacement planetary-motion machines described in the article above are distinguished from machines according to the invention by the geometry of the enclosure and of the piston. In fact, in the existing machines either the piston or the enclosure has a directrix which is a curtate hypotrochoid or epitrochoid, or a curve uniformly distant from a non-prolate (that is, ordinary or curtate) hypotrochoid or epitrochoid. All these curves have only one or two formal parameters, which cannot be selected except within narrow limits. Using these curves, it is not possible to meet all the desirable technological constraints in modern machines.

SUMMARY OF THE INVENTION

Conversely, the machines that are the subject of the invention have a geometry with many more formal parameters and in certain cases have technological advantages that facilitate their realization. According to the invention, one of the devices, male or female, has a directrix $D_1$ that is identified with a curve uniformly distant from a closed hypertrochoid having neither a double point nor a retrogressive point, excluding hypertrochoids degenerated into hypotrochoids, epitrochoids or peritrochoids. It is clear that while remaining within the scope of the invention, the directrix $D_1$ may also be at a zero distance from such a hypertrochoid and consequently may be identified with it. The definition of hypertrochoids is spelled out in French Patent A-2.203.421.

The other device, male or female, of the machines that are the subject of the invention has a directrix $D_2$, which is the envelope of $D_1$ in a relative planetary motion defined by two circles $C_1$ and $C_2$ with respective centers and radii $O_1$, $R_1$ on the one hand and $O_2$, $R_2$ on the other; these circles $R_1$ and $R_2$ are respectively solid with the directrixes $D_1$ and $D_2$ and roll on one another without slipping, by internal contact, and $|O_1O_2|$ specifies the center of the third device. The machines according to the invention may be classified in four categories, depending on the nature of the device the form of which is defined by $D_1$ and on the comparative values of the radii $R_1$ and $R_2$. The following distinctions should be made:

- machines in which $D_1$ is the directrix of the piston and $D_2$ is the directrix of the enclosure, which is identified with the outer envelope of $D_1$ in a planetary motion of $D_1$ relative to $D_2$ for which
  $R_1=s_PE$ and $R_2=s_cE=(s_P+1)E$, where $E=-|O_1O_2|$ (category I) shown schematically in FIGS. 1–4.
- machines in which $D_1$ is the directrix of the piston and $D_2$ is the directrix of the enclosure, which is identified with the outer envelope of $D_1$ in a planetary motion of $D_1$ relative to $D_2$ for which
  $R_1=s_PE$ and $R_2=s_cE=(s_P-1)E$, where $E=-|O_1O_2|$ and $s_P>1$ (category II) shown schematically in FIGS. 5–8.
- machines in which $D_1$ is the directrix of the enclosure and $D_2$ is the directrix of the piston, which is identified with the inner envelope of $D_1$ in a planetary motion of $D_1$ relative to $D_2$ for which
  $R_2=s_PE$ and $R_1=s_cE=(s_P-1)E$, where $E=-|O_1O_2|$ and $s_P>1$ (category III) shown schematically in FIGS. 1, 2, 5 and 6.
- machines in which $D_1$ is the directrix of the enclosure and $D_2$ is the directrix of the piston, which is identified with the inner envelope of $D_1$ in a planetary motion of $D_1$ relative to $D_2$ for which
  $R_2=s_PE$ and $R_1=s_cE=(s_P+1)E$, where $E=-|O_1O_2|$ (category IV) shown schematically in FIGS. 3, 4, 7 and 8.

Given that the parametric equation of the directrix $D_1$, which describes $Z_1(\kappa)$ in the complex plane $O_1XY$ (where $\kappa$ represents the kinematic parameter), the equation $Z_2$ of the envelopes of $D_1$ in the relative motion of $D_1$ with respect to $D_2$ defined by $R_1$ and $R_2$ can be obtained quite easily, in the complex plane $O_2XY$, by means of the two following relationships, where $\gamma$ represents the rotational angle of $D_1$ with respect to the third device, and/or $Z_3$ is the complex number conjugated from the derivative $Z_1$ with respect to $\kappa$:

$$Re\{Z_1Z_3-R_1Z_3\ expi\ (-\gamma)\}=0 \quad (1)$$

$$Z_2=(R_2-R_1)\ expi\ \{-\gamma R_1/R_2\}+Z_1\ expi\ \{\gamma(1-R_1/R_2)\} \quad (2)$$

Equation (1) furnishes a relationship between $\gamma$ and $\kappa$ which, when introduced into equation (2), enables the definition of $Z_2$ as a function of a single kinematic parameter, $\gamma$ or $\kappa$. It will be observed that if theoretically there is interest in finding the set ($\kappa^*$) corresponding to a particular position $\gamma^*$ of $D_1$, then it is numerically much easier to find the set of positions of $D_1$ defined by ($\gamma^{}$) for which the contact is established at a particular point of $D_1$ defined by $\kappa^{}$. It will also be noted that $Z_2$ corresponds to the inner and outer envelopes, that it is appropriate to separate these envelopes and to use one of them, depending on the category of machines that one wishes to make. This separation may for example be based on the comparison of the radii of curvature at the points of contact of $D_1$ and $D_2$.

The planetary motion of $D_1$ relative to $D_2$ may be realized in the machines that are the subject of the invention in three different ways:

The third device may be immobilized, and the piston and the enclosure may be made movable.

It is also possible to immobilize the piston and to make the enclosure and the third device movable.

Finally, and in principle this is the simplest way, the enclosure can be immobilized and the third device and the piston can be made movable.

Regardless of the absolute motions retained by the machines that are the subject of the invention, the absolute planetary motion may be achieved by a constant ratio transmission, and in particular by an internal gearing with parallel axes, the wheels $E_1$ and $E_2$ of which are solid with the piston and enclosure, respectively, and the primitive radii of which are respectively equal to $R_1$ and $R_2$.

If a constant ratio transmission is available to promote the relative planetary motion, then a functional play provided between the enclosure and the piston makes it possible to prevent the direct contact between these two elements and authorizes "dry" running of the machine.

If the direct contact between the piston and the enclosure is accepted, then, if the geometry of the contacting surfaces of these two elements enable sufficient control and if the fluid carried in the machine is sufficiently lubricating, the constant ratio transmission may be dispensed with and the relative planetary motion directly promoted by the piston-to-enclosure contact. In that case, the result is great simplicity in embodiment.

Regardless of the mechanical organization of the machines that are subject of the invention, these machines convert hydraulic energy into mechanical energy, or vice versa.

The mechanical energy is exchanged with the outside via a shaft. If the third device is movable, then this shaft is identified with it and in that case it is in the form of a crankshaft. When the third device is not movable, then this shaft, rectilinear in shape, is separate from it and is solid with the enclosure or the piston.

Hydraulic energy is introduced into or removed from the machine by a set of flaps, ports and/or valves disposed in the enclosure and/or in the piston, by the conventional techniques that are used in the known positive displacement machines and are directly applicable by one skilled in the art. These arrangements for distributing the fluid may optionally be adjustable to enable a variation in the displacement. Whether it is adjustable or not, the distribution of the fluid may be adapted to the nature of the fluid (that is, whether it is incompressible or compressible) and to the direction of energy conversion (a machine that generates fluid energy, i.e. a compressor or pump, or a machine that generates mechanical energy, that is, a motor).

It will be observed that in the particular case of machines where the third device is immovable, then when these machines belong to category I or II, and if the directrix $D_2$ is not completely identified with the envelope of $D_1$ in the relative planetary motion, the portion of the directrix $D_2$ that is outside this envelope may be omitted; the different portions of the directrix $D_2$ that are identified with the envelope are then discontinuous, and the directrix does not constitute a closed curve. In these machines, a fixed housing which is identified with the third device surrounds the enclosure to assure its tightness, while the enclosure and the piston assure the distribution of the fluid by periodically, in their absolute rotational motions, uncovering and plugging at least one fixed admission port and exhaust port each in the machine.

One group of particular machines belonging to category I is that in which the directrix $D_1$ satisfies the following equation in the complex plane:

$$Z_1=\{(1+S)/2\}\ E\ expi\{\kappa(1/S)-\kappa\}+R_m\ expi\{\kappa(1/S)\}+\{(1-S)/2\}\ E\ expi\{\kappa(1/S)+\kappa\} \quad (3)$$

in which $Z_1$ represents the affix of the generator point of the directrix $D_1$, each point being specified by a particular value of the kinematic parameter $\kappa$, the range of variation of which is between 0 and $2S\pi$ in order to traverse the curve one single time, S is an integer that designates the order of symmetry of $D_1$ with respect to the origin in the complex plane and is selected arbitrarily; expi represents the imaginary exponential function; E and $R_m$ are two lengths freely chosen providing the corresponding curve has neither a double point nor a retrogressive point, which indirectly limits the value of the ratio $E/R_m$.

BRIEF DESCRIPTION OF THE DRAWINGS

The invention will be described in detail with reference to the following drawings in which like reference numerals refer to like elements, and wherein.

Figure 9:
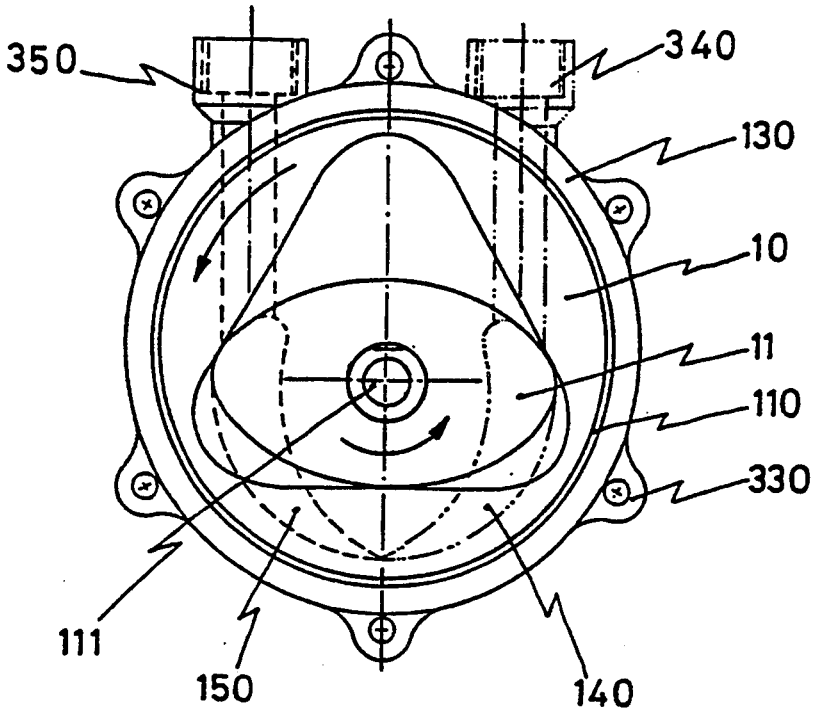
FIGS. 9 and 10 show a machine where the third, immovable device is identified with a housing surrounding the enclosure, with which the piston and the enclosure are rotoidally connected.
Figure 10:
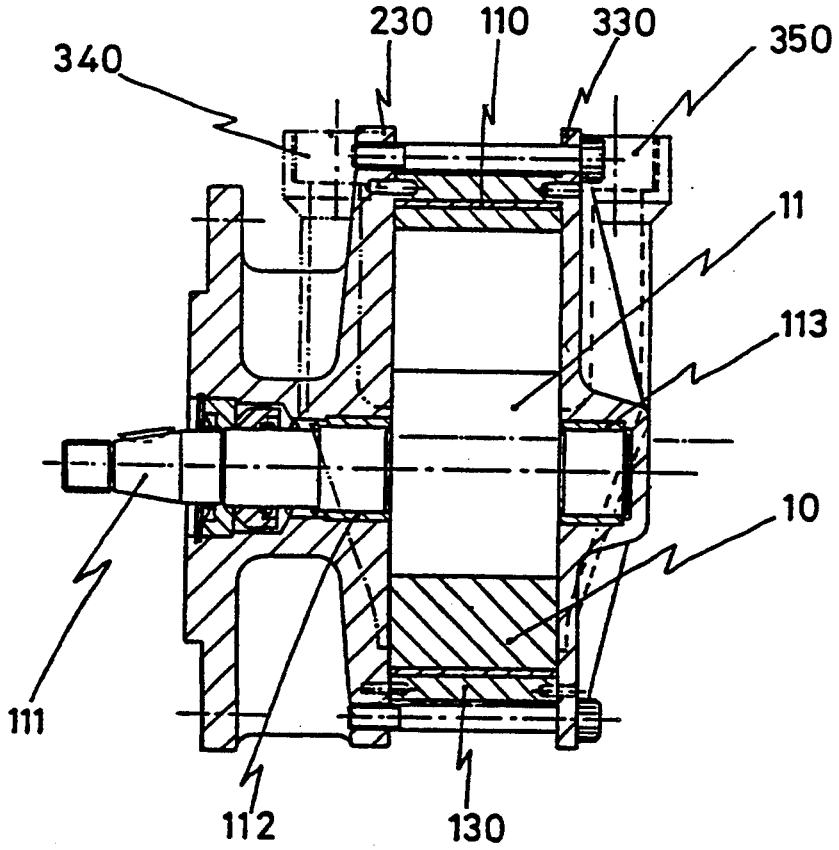

In the machines shown in FIGS. 9 and 10, the shape of the inner surface of the enclosure and of the outer surface of the piston correspond to the illustrations shown in FIGS. 1 through 4.

DETAILED DESCRIPTION OF THE PREFERRED EMBODIMENTS

Figure 1:
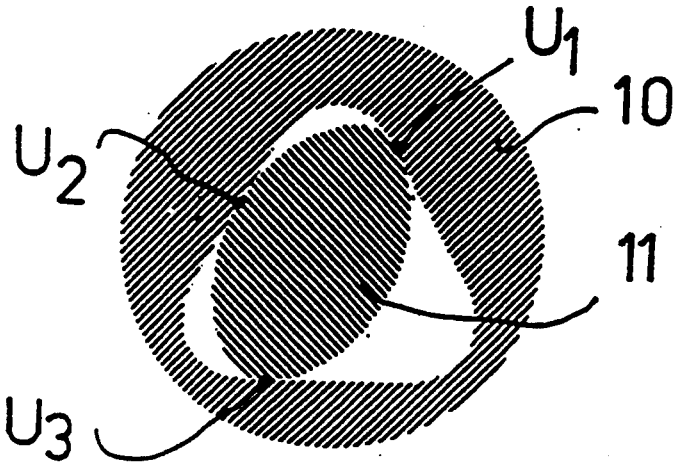
FIGS. 1–4 schematically show a machine according to the invention.
Figure 2:
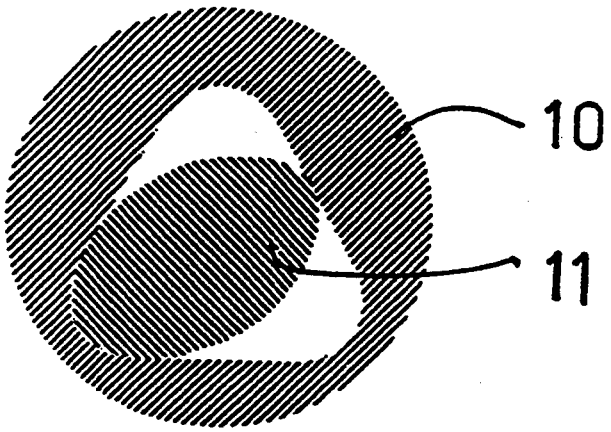
Figure 3:
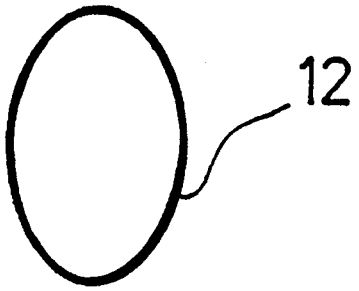
Figure 4:
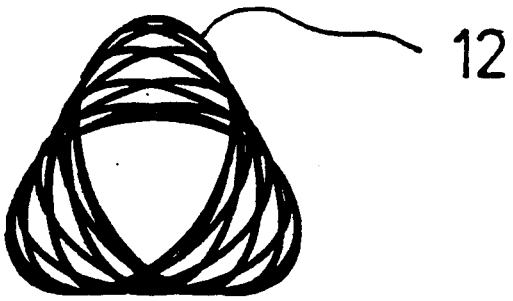
Figure 5:
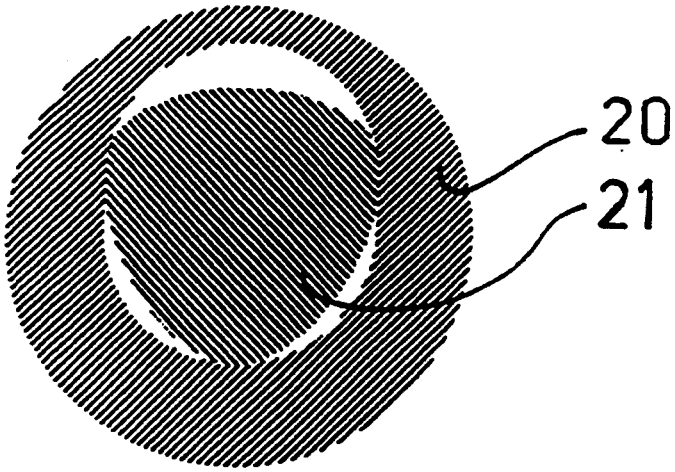
FIGS. 5–8 schematically show another machine according to the invention. These illustrations are the result of a digital simulation on the computer.
Figure 6:
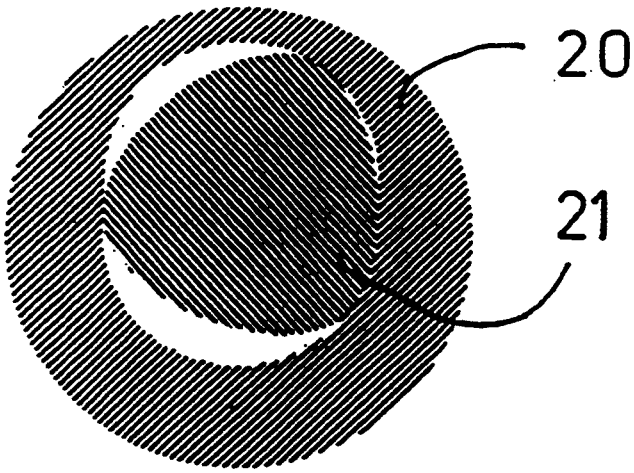

FIGS. 1 and 2, for two particular positions of the piston, show a section perpendicular to the axes of a machine in category I, characterized by $s_P=2$, $s_C=3$, $E=10$ mm, $R_1=20$ mm, $R_2=30$ mm, and the directrix $D_1$ of which meets equation (3), where $S=s_P$ and $R_m=45$ mm. In these two drawing figures, the enclosure (10) with the directrix $D_2$ that surrounds the piston (11) with the directrix $D_1$ can be distinguished. Three points of contact $U_1$, $U_2$, $U_3$ between $D_1$ and $D_2$ can be clearly seen in FIG. 1. FIG. 3 shows the directrix $D_1$ (12), and FIG. 4 shows several positions of $D_1$ with respect to the enclosure, the latter not being shown in the drawing for the sake of clarity.

A study of this machine shows the following:

$$Z_3=-i\{\{(1/S)-1\}\{(1+S)/2\}\ E\ expi\{-\kappa(1/S)+\kappa\}+\{(1/S)\}R_m\ expi\{-\kappa(1/S)\}+\{(1/S)+1\}\{(1-S)/2\}\ E\ expi\{-\kappa(1/S)-\kappa\}\}$$

From this, one can deduce the following:

$$Re\{Z_1Z_3\}=-ER_m \sin(\kappa)-\{(1-S^2)/2\}E^2 \sin(2\kappa)$$

and $$Re\{R_1Z_3expi(-\gamma)\}=\{(1/S)-1\}\{(1+S)/2\}R_1E \sin\{-\kappa(1/S)+\kappa-\gamma\}+\{(1/S)\}R_1R_m \sin\{-\kappa(1/S)-\gamma\}+\{(1/S)+1\}\{(1-S)/2\}R_1E \sin\{-\kappa(1/S)-\kappa-\gamma\}$$

If $$\kappa+\kappa(1/S)+\gamma=(21+1)\pi$$

where $$1=0,1,S=2 \tag{4}$$

$$\sin\{-\kappa-\kappa(1/S)-\gamma\}=0$$

and, because $R_1=s_PE=SE$, $$Re\{R_1Z_3expi(-\gamma)\}=\{(1/S)-1\}\{(1+S)/2\}SE^2 \sin\{2\kappa+\pi\}+\{(1/S)\}SER_m \sin\{\kappa+\pi\}$$

or $$Re\{R_1Z_3expi(-\gamma)\}=\{(1-S)/S\}\{(1+S)/2\}SE^2 \sin\{2\kappa+\pi\}+\{(1/S)\}SER_m \sin\{\kappa+\pi\}.$$

Consequently, equation (1) is indeed verified simultaneously with equation (4).

The general expression of equation (2) gives the expression of $Z_2$, which is described here taking equation (4) into account as well as the fact that $R_2=(s_P+1)E=(S+1)E$:

$$Z_2=E\ expi\{-\gamma(S/S+1)\}+\{(1+S)/2\}\ E\ expi\{\kappa(1/S)-\kappa+\gamma-\gamma(S/S+1)\}+R_m\ expi\{\kappa(1/S)+\gamma-\gamma(S/S+1)\}+\{(1-S)/2\}\ E\ expi\{\kappa(1/S)+\kappa+\gamma-\gamma(S/S+1)\}$$

To simplify the description, assuming, $$A=\{(1+S)/2\}\ E,$$

then it appears that:

$$Z_2=\{A\ expi(-\kappa)+R_m-A\ expi(+\kappa)\}\{expi\{\kappa(1/S)+\gamma-\gamma(S/S+1)\}\}$$

or again, taking equation (4) into account, $$Z_2=\{A\ expi(-\kappa)+R_m-A\ expi(+\kappa)\}\{expi\{(1/S+1)(21+1)\pi\}\}$$

The term $\{A\ expi(-\kappa)+R_m-A\ expi(+\kappa)\}$ of this expression represents a straight-line segment oriented along the axis of the ordinate, passing through the abcissa point $R_m$ and ordinate O. Its length equals 4A, that is, (1+S)2E.

The product $$\{A\ expi(-\kappa)+R_m-A\ expi(+\kappa)\}\{expi\{(1/S+1)(21+1)\pi\}\}$$

represents the same straight-line segment, rotated by $$\{-(1/S+1)(21+1)\pi\}$$

where $$1=0,\ 1,\ S=2,$$

that is, 60°, 180°, and 300°.

From the above result, obtained when equation (1) is solved with values of $\kappa$ and $\gamma$ that are compatible with equation (4), it is found that $D_2$ includes three straight-line segments equal in length to (1+S)2E, disposed at $2\pi/(S+1)$ with respect to one another.

These three straight-line segments are joined by other equations between $\kappa$ and $\gamma$ that solve equation (1). This corresponds to three arcs of variable curvature.

When equation (4) is verified, then for all the angular positions of the piston defined by $\gamma$, there are three points of contact with the directrix, and these points are defined by the three corresponding values of 1 and hence of $\kappa$.

A value of $\kappa$ and a value of $\gamma$ that verify one of the solutions of equation (4) define a point of contact located on one of the three straight-line segments of $D_2$, and for a particular value of $\gamma$, one straight-line segment of $D_2$ corresponds to each solution of equation (4). As a result, on the one hand the directrix of the enclosure must be identified with these three straight-line segments, and outside these segments can be spaced apart from the directrix $D_2$, providing it is outside this directrix. In that case, the contacts of the directrix of the enclosure with the directrix $D_1$ of the piston always take place at three points, and the relative planetary motion between the piston and the enclosure can be achieved directly by these contacts, without any need for recourse to gearing physically embodying the wheels $E_1$ and $E_2$. The result is great ease of manufacture, since the number of constituent devices of the machine is reduced to the absolute minimum, and machining of the enclosure surface is extremely simple because it is reduced to that of three planes. It will be observed that in this machine, three work chambers are permanently available into which the fluid can be introduced and from which it can escape.

FIGS. 5–8, respectively, have the same meaning as FIGS. 1–4 (enclosure (20), piston (21) and directrix $D_1$ (22) of the piston (21)), but for a machine of category II, where $s_P=3$, $s_C=2$, E=10 mm, $R_1=30$ mm, $R_2=20$ mm, and with a directrix $D_1$ of the piston defined by the following equation:

$$Z_1=15\ expi(-2\kappa/3)+120\ expi(+\kappa/3)-5\ expi(4\kappa/3).$$

The directrix $D_2$ of the corresponding enclosure has a symmetry on the order of 2. Solving equation (1) for all the relative piston and enclosure positions shows that three contact permanently exist between $D_1$ and its outer envelope $D_2$. This leads to the existence of three work chambers for the fluid.

Turning to FIGS. 3 and 4 on the one hand, and 7 and 8 on the other, the following results can also be observed:

FIG. 4 shows the planetary motion of a curve $D_1$ with an order of symmetry equal to 2, shown in FIG. 3. The planetary motion is characterized by the rolling of a circumference $C_1$ with a radius equal to 2E (with which the directrix $D_1$ is associated) on a fixed circumference $C_2$ having a radius equal to 3E. In FIG. 4, the outer and inner envelopes that are solid with this fixed circumference $C_2$ can be seen. These envelopes both have an order of symmetry equal to 3.

If $D_1$ and its outer envelope $D_2$ are physically embodied, with $R_1=2E$ and $R_2=3E$, then $D_1$ is the piston and $D_2$ is the enclosure, and $s_P=2$, $s_C=3$, $R_1$ is indeed equal to $s_PE$ and $R_2$ is equal to $s'_CE=(s_P+1)E$.

The corresponding machine belongs to category (I).

If $D_1$ and its inner envelope $D_2$ are physically embodied, with $R_1=2E$ and $R_2=3E$, then $D_1$ is the enclosure, $D_2$ is the piston, and $s_C=2$, $s_P=3$, $R_2$ is indeed equal to $s_PE$ and $R_1$ is equal to $s_CE=(s_P-1)E$.

The corresponding machine belongs to category (III).

Figure 7:
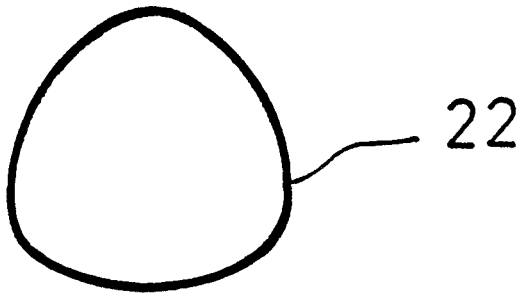
Figure 8:
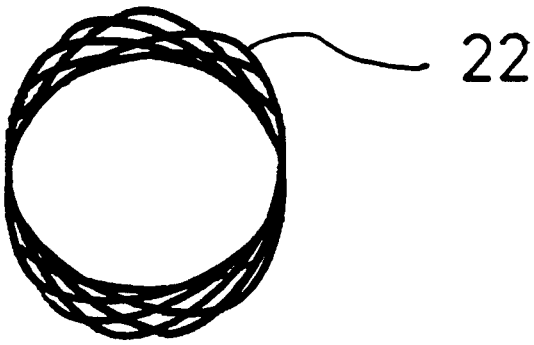

FIG. 8 shows the planetary motion of a curve $D_1$ with an order of symmetry equal to 3, shown in FIG. 7. The planetary motion is characterized by the rolling of a circumference $C_1$ with a radius equal to 3E (with which the directrix $D_1$ is associated) on a fixed circumference $C_2$ having a radius equal to 2E. In FIG. 8, the outer and inner envelopes that are solid with this fixed circumference $C_2$ can be seen. These envelopes both have an order of symmetry equal to 2.

If $D_1$ and its outer envelope $D_2$ are physically embodied, with $R_1=3E$ and $R_2=2E$, then $D_1$ is the piston and $D_2$ is the enclosure, and $s_P=3$, $s_C=2$, $R_1$ is indeed equal to $s_PE$ and $R_2$ is equal to $s_CE=(s_P-1)E$.

The corresponding machine belongs to category (II).

If $D_1$ and its inner envelope $D_2$ are physically embodied, with $R_1=3E$ and $R_2=2E$, then $D_1$ is the enclosure, $D_2$ is the piston, and $s_C=3$, $s_P=2$, $R_2$ is indeed equal to $s_PE$ and $R_1$ is equal to $s_CE=(s_P+1)E$.

The corresponding machine belongs to category (IV).

FIG. 9 is a machine that includes a piston and an enclosure in rotoidal connection with a fixed housing; this view in the direction of the axes of the rotoidal connections shows the machine without the flange located toward the drive.

FIG. 10 is a sectional view in the machine along a plane containing the axes of the two rotoidal connections. The piston 11, the capsule 10, and the housing constituted by a tubular portion 130 and two flanges 230 and 330 can be distinguished in this sectional view.

In the machine shown, the piston 11 is integral with the shaft 111 whose bearings 112 and 113 physically embody the rotoidal connection of the piston 11 with the flanges 230 and 330 of the housing. The enclosure 10 is in rotoidal connection, via the plain bearing 110, with the tubular portion 130 of the housing. The admission of the fluid to the machine is done via the port 140, which is connected in the flange 230 to the tube 340, and it is exhausted via the port 150 connected to the tube 350 in the flange 330.

In the present description, the shapes claimed for the piston and the enclosure and the planetary nature of the motion are to be understood as nominal characteristics of the machines according to the invention.

While this invention has been described in conjunction with specific embodiments thereof, it is evident that may alternatives, variations and modifications will be apparent to those skilled in the art. Accordingly, the preferred embodiments of the invention as set forth herein, are intended to be illustrative, not limiting. Various changes may be made without departing from the spirit and scope of the invention as defined in the specification and following claims.

We claim:

1. A positive displacement machine including a cylindrical mechanism, essentially constituted by a cylindrical piston (male device) having an integral order of symmetry $s_P$ with respect to its axis, a cylindrical enclosure that surrounds it (female device), having an integral order of symmetry $s_C$ with respect to its axis, and a third device physically embodying two axes, parallel to those of the cylindrical surfaces defining the shape of the piston and enclosure, this third device being in rotoidal connection about its axes with the piston and the enclosure, respectively, the orders of symmetry $s_P$ and $s_C$ differing from each other by one and the geometries of the piston and enclosure being defined so that these devices are in direct contact, characterized in that one of the devices, male or female, has a directrix $D_1$ which is identified with a curve that is uniformly distant (the uniform distance optionally being zero) from a closed hypertrochoid, excluding hypertrochoids degenerated into hypotrochoids, peritrochoids and epitrochoids or with curves uniformly distant from these hypotrochoids, peritrochoids and epitrochoids, this hypertrochoid having neither a double point nor a retrogressive point, the other device having a directrix $D_2$ which is the envelope of $D_1$ in a relative planetary motion defined by two circles $C_1$ and $C_2$, having respective centers and radii ($O_1$, $R_1$ and ($O_2$, $R_2$), which are respectively solid with the directrixes $D_1$ and $D_2$ and roll on one another without slipping, by internal contact, $|O_1O_2|$ specifying the center distance between the axes of the third device.

2. The positive displacement machine according to claim 1, characterized in that $D_1$ (22) is the directrix of the piston (21), $D_2$ is the directrix of the enclosure (20) which is identified with the outer envelope of $D_1$ in the planetary motion of $D_1$ relative to $D_2$, defined by $R_1=S_PE$ and $R_2=S_CE=(S_P-1)E$, where $E=|O_1O_2|$, and $S_P>1$.

3. The positive displacement machine according to claim 1, characterized in that $D_1$ is the directrix of the enclosure, $D_2$ is the directrix of the piston which is identified with the inner envelope of $D_1$ in the planetary motion of $D_1$ relative to $D_2$, defined by $R_2=S_PE$ and $R_1=S_CE=(S_P+1)E$, where $E=|O_1O_2|$.

4. The positive displacement machine according to claim 1, wherein $D_1$ is the directrix of the enclosure, $D_2$ is the directrix of the piston which is identified with the inner envelope of $D_1$ in the planetary motion of $D_1$ relative to $D_2$, defined by $R_2=S_pE$ and $R_1=S_CE=(S_P-1)E$, where $E=|O_1O_2|$ and $S_P>1$.

5. The positive displacement machine according to claim 1, characterized in that $D_1$ (12) is the directrix of the piston (11), $D_2$ is the directrix of the enclosure (10) which is identified with the outer envelope of $D_1$ in the planetary motion of $D_1$ relative to $D_2$, defined by $R_1=S_PE$ and $R_2=S_CE=(S_P+1)E$, where $E=|O_1O_2|$.

6. The positive displacement machine according to claim 5, wherein a hypertrochoid, in the complex plane, satisfies the following equation:

$$Z_1=\{(1+S)/2\}\ E\ expi\ (\kappa(1/S)-\kappa\}+R_m\ expi\ \{\kappa(1/S)\}+\{(1-S)/2\}\ E\ expi\ \{\kappa(1/S)+\kappa\}$$

wherein, $Z_1$ stands for an affix of a generator point of the directrix $D_1$, each point being specified by a particular value of a kinematic parameter $\kappa$, the range of variation of which is between 0 and $2S\pi$, in order to traverse the curve one single time, S is an integer which designates an order of symmetry of the curve with respect to the origin of the complex plane and is selected arbitrarily, expi represents the imaginary exponential function, E and $R_m$ are two lengths selected freely on the condition that the corresponding curve represents neither a double point nor a retrogressive point.

* * * * *